US008537078B2

(12) United States Patent
Jo

(10) Patent No.: US 8,537,078 B2
(45) Date of Patent: Sep. 17, 2013

(54) PIXEL CIRCUIT, DRIVING CIRCUIT, LIGHT EMITTING APPARATUS, ELECTRONIC APPARATUS AND DRIVING METHOD OF PIXEL CIRCUIT

(75) Inventor: Hiroaki Jo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 689 days.

(21) Appl. No.: 12/796,391

(22) Filed: Jun. 8, 2010

(65) Prior Publication Data

US 2011/0001740 A1 Jan. 6, 2011

(30) Foreign Application Priority Data

Jul. 1, 2009 (JP) ..... 2009-156602

(51) Int. Cl.
*G09G 3/30* (2006.01)

(52) U.S. Cl.
USPC ..... 345/76; 345/204; 345/211

(58) Field of Classification Search
USPC ..... 345/76–98, 204
See application file for complete search history.

(56) References Cited

U.S. PATENT DOCUMENTS 8,232,933 B2 7/2012 Kim
2004/0257353 A1* 12/2004 Imamura et al. ..... 345/204
2005/0140600 A1* 6/2005 Kim et al. ..... 345/76
2005/0200575 A1 9/2005 Kim et al.
2007/0128583 A1* 6/2007 Miyazawa ..... 434/433
2007/0296652 A1* 12/2007 Imamura et al. ..... 345/76
2008/0074412 A1* 3/2008 Nozawa ..... 345/212
2009/0219232 A1* 9/2009 Choi ..... 345/76

FOREIGN PATENT DOCUMENTS

JP A-2005-258407 9/2005
JP A-2008-176272 7/2008

* cited by examiner

*Primary Examiner* — Viet Pham
(74) *Attorney, Agent, or Firm* — Oliff & Berridge, PLC

(57) ABSTRACT

Disclosed is a pixel circuit including a light emitting element having one terminal and the other terminal, a driving transistor that supplies a driving current to the one terminal of the light emitting element, a first power line electrically connected to the other terminal of the light emitting element and receiving a first potential, a control transistor provided between a second power line, which receives a second potential, and a source of the driving transistor, and having a gate that receives a control signal through a control line, a first capacitor provided between the second power line and a gate of the driving transistor, a second capacitor provided between the gate and the source of the driving transistor, and a select transistor provided between a data line, which receives a data potential, and the gate of the driving transistor, and having a gate that receives a scanning signal through a scanning line.

15 Claims, 8 Drawing Sheets

(a) FIRST PERIOD T1

(b) SECOND PERIOD T2

(c) THIRD PERIOD T3

PIXEL CIRCUIT, DRIVING CIRCUIT, LIGHT EMITTING APPARATUS, ELECTRONIC APPARATUS AND DRIVING METHOD OF PIXEL CIRCUIT

BACKGROUND

1. Technical Field

The present invention relates to a technology of driving a light emitting element such as an organic EL (Electroluminescence) element.

2. Related Art

In a light emitting apparatus in which a driving transistor controls a driving current supplied to a light emitting element, an error (difference from a target value and variation between elements) of electrical properties of the driving transistor may be problem. For example, JP-A-2005-258407 discloses a configuration of compensating for the difference of a threshold voltage of the driving transistor. FIG. 15 is a diagram illustrating the configuration of a pixel circuit disclosed in JP-A-2005-258407.

However, according to the technology disclosed in JP-A-2005-258407, since four or more TFTs are required per one pixel circuit and the large number of control signals and power sources is required, it is problematic in that a configuration for performing a compensation operation is complicated.

Further, according to the technology disclosed in JP-A-2005-258407, since one pixel circuit includes both an N channel type transistor and a P channel type transistor, it is problematic in that it is difficult to make properties of each transistor included in the pixel circuit to be uniform.

Furthermore, according to the technology disclosed in JP-A-2005-258407, since a compensation period is provided separately from a data writing period, it is problematic in that it is difficult to sufficiently ensure a light emitting period.

SUMMARY

An advantage of some aspects of the invention is to provide a pixel circuit, a driving circuit, a light emitting apparatus, an electronic apparatus and a driving method of the pixel circuit, which can solve the above problems.

According to one aspect of the invention, there is provided a pixel circuit including: a light emitting element having one terminal and the other terminal; a driving transistor that supplies a driving current to the one terminal of the light emitting element; a first power line electrically connected to the other terminal of the light emitting element and receiving a first potential; a control transistor provided between a second power line, which receives a second potential, and a source of the driving transistor, and having a gate that receives a control signal through a control line; a first capacitor provided between the second power line and a gate of the driving transistor; a second capacitor provided between the gate and the source of the driving transistor; and a select transistor provided between a data line, which receives a data potential, and the gate of the driving transistor, and having a gate that receives a scanning signal through a scanning line. According to the embodiment, since the number of transistors included in the pixel circuit is three (the driving transistor, the control transistor and the select transistor), the configuration of the pixel circuit can be simplified as compared with the related art of FIG. 15.

Further, it is preferred that the driving transistor, the control transistor and the select transistor include the same channel type transistor. According to the embodiment, it is possible to make properties of each transistor included in the pixel circuit to be uniform, as compared with the related art of FIG. 15. When all the transistors included in the pixel circuit use a P channel type transistor, with regard to the highs and lows of the first potential and the second potential, the first potential is smaller than the second potential. Meanwhile, when all the transistors included in the pixel circuit use an N channel type transistor, the voltage relation (high and low) is reversed as compared with the case of employing the P channel type transistor.

A driving circuit that drives the above-described pixel circuit includes: a first unit (e.g., a scanning line driving circuit 22 shown in, for example, FIG. 1) that generates a scanning signal to supply a scanning line with the scanning signal; a second unit (e.g., a scanning line driving circuit 22 shown in, for example, FIG. 1) that generates a control signal to supply a control line with the control signal; and a third unit (e.g., a data line driving circuit 24 shown in, for example, FIG. 1) that generates a data potential to supply a data line with the data potential, wherein in a first period (a first period T1 shown in FIG. 3), the first unit supplies the scanning line with the scanning signal to allow the select transistor to be turned on, the second unit supplies the control line with the control signal to allow the control transistor to be turned on, and the third unit supplies the data line with the data potential, in a second period (a second period T2 shown in FIG. 3), the first unit supplies the scanning line with the scanning signal to allow the select transistor to be turned on, the second unit supplies the control line with the control signal to allow the control transistor to be turned off, and the third unit supplies the data line with the data potential, and in a third period (a third period T3 shown in FIG. 3), after the first unit supplies the scanning line with the scanning signal to allow the select transistor to be turned off, the second unit supplies the control line with the control signal to allow the control transistor to be turned on. According to the invention, in the first and second periods, the data potential is written. In the second period, a compensation operation is performed to allow a voltage between the gate and the source of the driving transistor to approach the threshold voltage of the driving transistor. That is, writing of the data potential and the compensation operation are performed at the same time, so that the light emitting period of the light emitting element can be sufficiently ensured as compared with the related art of FIG. 15 in which the period for performing the compensation operation is provided separately from the writing period of the data potential. Further, according to the invention, the number of the control signals and power sources can be reduced as compared with the related art of FIG. 15, so that the configuration for performing the compensation operation can be simplified.

A driving circuit that drives the above-described pixel circuit includes: a first unit that generates a scanning signal to supply a scanning line with the scanning signal; a second unit that generates a control signal to supply a control line with the control signal; and a third unit that generates a data potential to supply a data line with the data potential, wherein in a first period (a first period T11 shown in FIG. 7), the first unit supplies the scanning line with the scanning signal to allow the select transistor to be turned off, and the second unit supplies the control line with the control signal to allow the control transistor to be turned on, in a second period (a second period T22 shown in FIG. 7), after the second unit supplies the control line with the control signal to allow the control transistor to be turned off, the first unit supplies the scanning line with the scanning signal to allow the select transistor to be turned on, and the third unit supplies the data line with the data potential, and in a third period (a third period T33 shown in FIG. 7), after the first unit supplies the scanning line with the scanning signal to allow the select transistor to be turned off, the second unit supplies the control line with the control signal to allow the control transistor to be turned on. According to the invention, since the control transistor is set to the off state over the period until the writing period is completed from before the writing period of the data potential starts, it is possible to prevent instantaneous high-luminance light emission from occurring due to the writing of the data potential immediately after the writing period starts, differently from the case in which the control transistor is maintained in an on state in a predetermined period immediately after the writing period starts.

The pixel circuit and the driving circuit according to the invention can be used for a light emitting apparatus. Further, the light emitting apparatus can be used for various electronic apparatuses. A typical example of the electronic apparatus is an apparatus using the light emitting apparatus as a display apparatus. As the electronic apparatus according to the invention, a personal computer and a cell phone are exemplified.

The invention is also specified as a method for driving a pixel circuit. A driving method of the pixel circuit according to the invention, is provided, which includes a light emitting element having one terminal and the other terminal, a driving transistor that supplies a driving current to the one terminal of the light emitting element, a first power line electrically connected to the other terminal of the light emitting element and receiving a first potential, a control transistor provided between a second power line, which receives a second potential, and a source of the driving transistor, and having a gate that receives a control signal through a control line, a first capacitor provided between the second power line and a gate of the driving transistor, a second capacitor provided between the gate and the source of the driving transistor, and a select transistor provided between a data line, which receives a data potential, and the gate of the driving transistor, and having a gate that receives a scanning signal through a scanning line. The driving method includes: in a first period, supplying the scanning line with the scanning signal to allow the select transistor to be turned on, supplying the control line with the control signal to allow the control transistor to be turned on, and supplying the data line with the data potential; in a second period, supplying the scanning line with the scanning signal to allow the select transistor to be turned on, supplying the control line with the control signal to allow the control transistor to be turned off, and supplying the data line with the data potential; and in a third period, supplying the scanning line with the scanning signal to allow the select transistor to be turned off, and then supplying the control line with the control signal to allow the control transistor to be turned on.

A driving method of the pixel circuit according to the invention, is provided, which includes a light emitting element having one terminal and the other terminal, a driving transistor that supplies a driving current to the one terminal of the light emitting element, a first power line electrically connected to the other terminal of the light emitting element and receiving a first potential, a control transistor provided between a second power line, which receives a second potential, and a source of the driving transistor, and having a gate that receives a control signal through a control line, a first capacitor provided between the second power line and a gate of the driving transistor, a second capacitor provided between the gate and the source of the driving transistor, and a select transistor provided between a data line, which receives a data potential, and the gate of the driving transistor, and having a gate that receives a scanning signal through a scanning line. The driving method includes: in a first period, supplying the scanning line with the scanning signal to allow the select transistor to be turned off, and supplying the control line with the control signal to allow the control transistor to be turned on; in a second period, supplying the control line with the control signal to allow the control transistor to be turned off, supplying the scanning line with the scanning signal to allow the select transistor to be turned on, and supplying the data line with the data potential; and in a third period, supplying the scanning line with the scanning signal to allow the select transistor to be turned off, and then supplying the control line with the control signal to allow the control transistor to be turned on.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
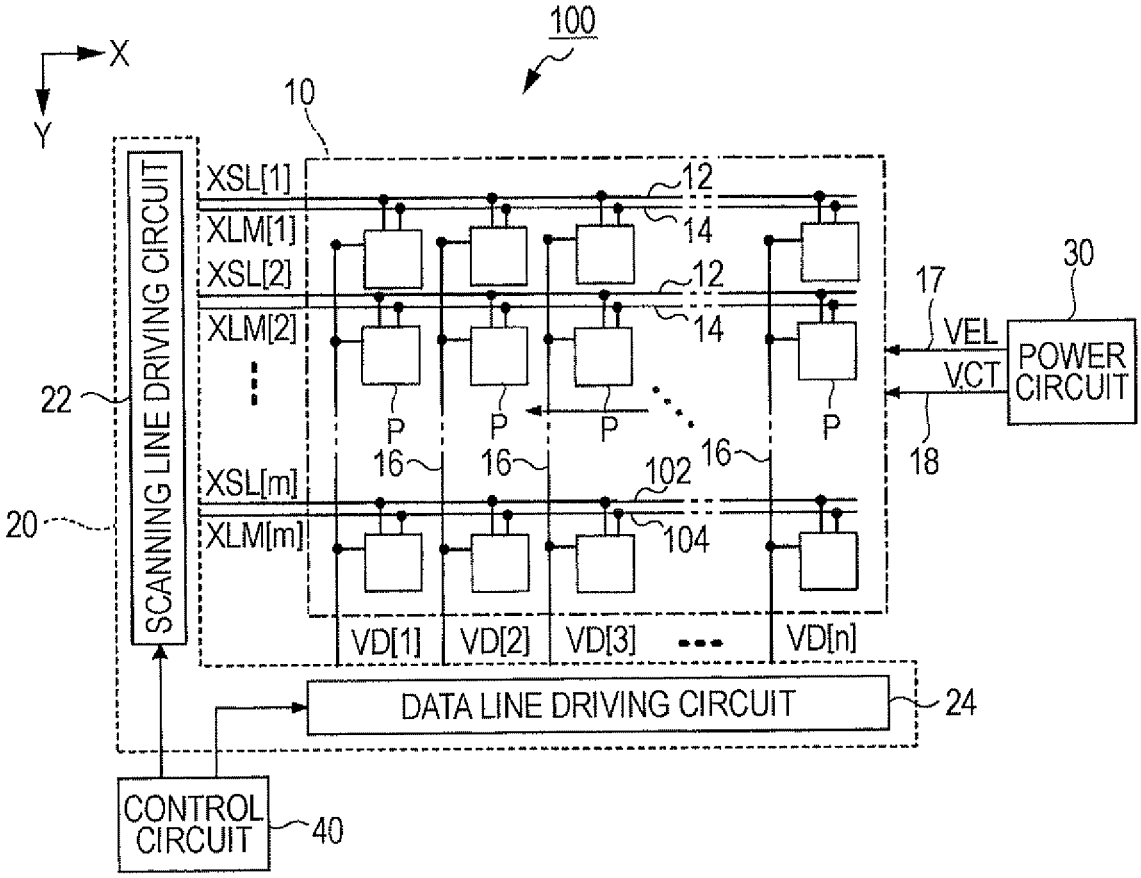
FIG. 1 is a block diagram illustrating a light emitting apparatus according to a first embodiment.

FIG. 1 is a block diagram illustrating a light emitting apparatus 100 according to the first embodiment of the invention. The light emitting apparatus 100 is mounted in an electronic apparatus as a display apparatus that displays an image. As shown in FIG. 1, the light emitting apparatus 100 includes a device unit 10 in which a plurality of pixel circuits P are arranged, a driving circuit 20 that drives each pixel circuit P, a power circuit 30 and a control circuit 40. In FIG. 1, the driving circuit 20, the power circuit 30 and the control circuit 40 are shown as separate circuits. However, it may be possible to employ a configuration in which a part or the whole of these circuits is designed as a single circuit.

The device unit 10 includes m scanning lines 12 extending in the X direction, m control lines 14 each extending in the X direction together with each scanning line 12 as a pair, and n data lines 16 extending in the Y direction perpendicular to the X direction, wherein m and n are natural numbers. The plurality of pixel circuits P are arranged in the intersection areas of each scanning line 12 and each data line 16 in a matrix shape of m rows vertically and n columns horizontally.

The driving circuit 20 includes a scanning line driving circuit 22 and a data line driving circuit 24. The scanning line driving circuit 22 is used for selecting the plurality of pixel circuits P every horizontal scanning period by the row. The scanning line driving circuit 22 selects the scanning line 12 every one horizontal scanning period by one row and outputs a control signal synchronized with this selection to the control line 14. For the purpose of convenience, a scanning signal output to the scanning line 12 of an $i^{th}$ row (i is an integer and $1 \leqq i \leqq m$) will be written as an XSL [i] and a control signal output to the control line 14 of an $i^{th}$ row will be written as an XLM [i].

The data line driving circuit 24 generates data potentials VD[1] to VD[n] corresponding to the n pixel circuits P of one row, which correspond to the scanning line 12 selected by the scanning line driving circuit 22 in each horizontal scanning period, and outputs the data potentials VD[1] to VD[n] to each data line 16. The data potential VD[j], which is output to the data line 16 of a $j^{th}$ column (j is an integer and $1 \leqq j \leqq n$) in the horizontal scanning period in which the $i^{th}$ row is selected, is equal to a potential corresponding to a grayscale designated with respect to the pixel circuit P located at the $j^{th}$ column of the $i^{th}$ row.

The power circuit 30 generates a potential VEL on the higher side and a potential VCT on the lower side of the power source. The potential VEL is commonly supplied to all pixel circuits P through a power feeder line 17. Similarly to this, the potential VCT is commonly supplied to all pixel circuits P through a power feeder line 18.

The control circuit 40 controls the scanning line driving circuit 22 and the data line driving circuit 24 by supplying them with a clock signal (not shown) and the like, and supplies the data line driving circuit 24 with image data for defining a grayscale every one frame of each pixel circuit P in the device unit 10.

Figure 2:
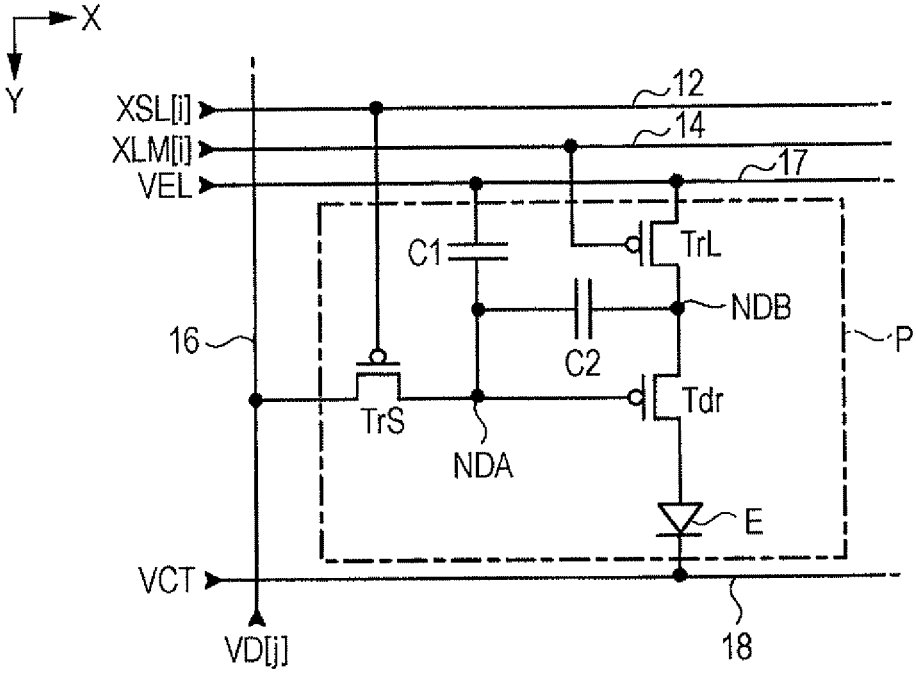
FIG. 2 is a circuit diagram illustrating a pixel circuit.

Next, the configuration of each pixel circuit P will be described with reference to FIG. 2. FIG. 2 illustrates only one pixel circuit P located at the $j^{th}$ column of the $i^{th}$ row, and other pixel circuits P also have the same configuration. As shown in FIG. 2, the pixel circuit P includes a light emitting element E, a driving transistor Tdr, a control transistor TrL, a select transistor TrS, a first capacitor C1 and a second capacitor C2. The light emitting element E, the driving transistor Tdr and the control transistor TrL are serially arranged on a path through which the power feeder line 17 is connected to a power feeder line 18. The light emitting element E is an organic EL (Electroluminescence) element in which a light emitting layer made of an organic EL material is interposed between an anode and a cathode facing each other. The light emitting element E is arranged between the power feeder line 18 and the driving transistor Tdr.

The driving transistor Tdr, the control transistor TrL and the select transistor TrS include the same channel type transistor. According to the embodiment, each of the driving transistor Tdr, the control transistor TrL and the select transistor TrS includes a P channel type transistor.

The control transistor TrL is arranged between the power feeder line 17 and a source of the driving transistor Tdr and has a gate connected to the control line 14.

The select transistor TrS is arranged between a gate of the driving transistor Tdr and the data line 16 and has a gate connected to the scanning line 12.

The first capacitor C1 is arranged between a node NDA (the gate of the driving transistor Tdr), which is interposed between the gate of the driving transistor Tdr and the select transistor TrS, and the power feeder line 17. Further, the second capacitor C2 is arranged between a node NDB (the source of the driving transistor Tdr), which is interposed between the source of the driving transistor Tdr and the control transistor TrL, and the node NDA.

Figure 3:
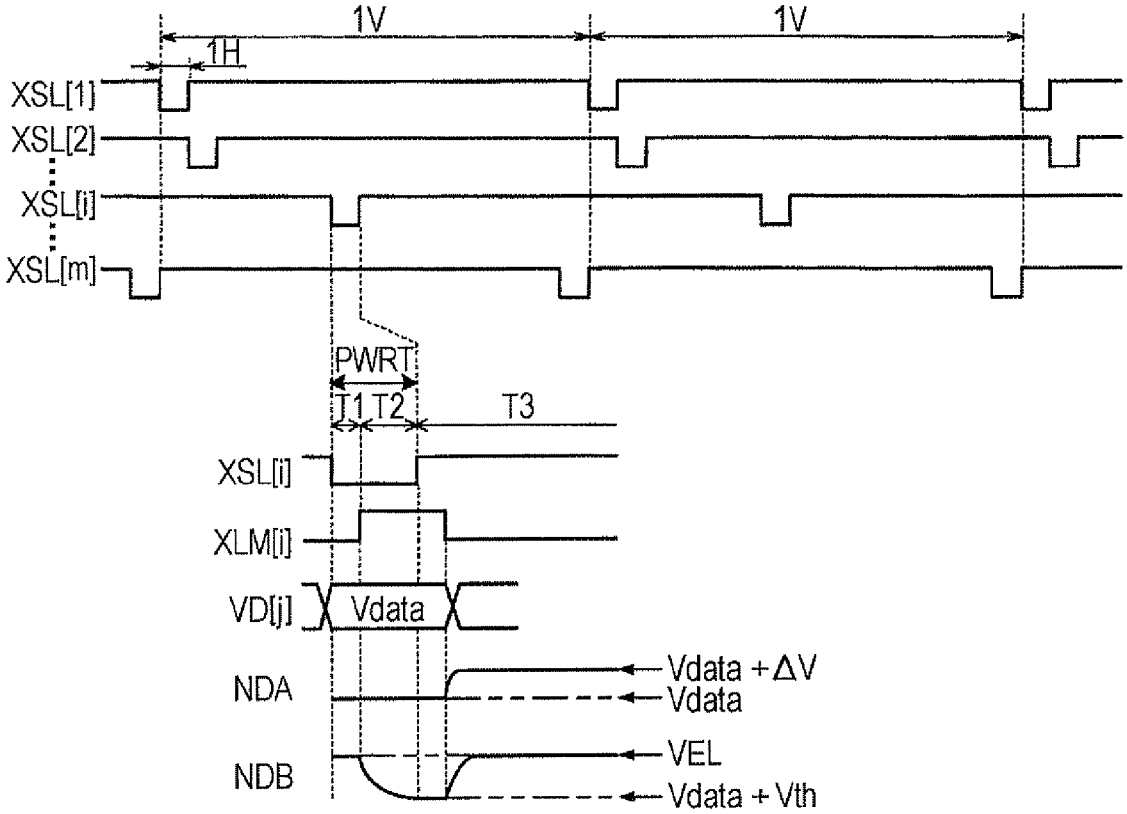
FIG. 3 is a timing chart illustrating the operation of a light emitting apparatus.

Next, detailed waveforms of each signal used for the operation of the light emitting apparatus 100 will be described with reference to FIG. 3. As shown in FIG. 3, scanning signals XSL[1] to XSL[m] are sequentially at an active level (low level) every horizontal scanning period (1H). That is, the scanning signal XSL[i] maintains a low level in an $i^{th}$ horizontal scanning period of a vertical scanning period (1V), and maintains a high level (inactive level) in other horizontal scanning periods. Transition of the scanning signal XSL[i] to the low level means the selection of each pixel circuit P of the $i^{th}$ row. Hereinafter, the period in which each of the scanning signals XSL[1] to XSL[m] is at the low level will be written as a "writing period PWRT". Further, FIG. 3 illustrates the case in which the scanning signal XSL[i] rises and the scanning signal XSL[i+1] of the next row falls at the same time. However, the scanning signal XSL[i+1] of the next row may fall at the timing after a predetermined time lapses from the rising of the scanning signal XSL[i].

FIG. 3 will be described while focusing on the $i^{th}$ row. The writing period PWRT includes a first period T1 and a second period T2 immediately after the first period T1. If the writing period PWRT is completed, a third period T3 starts.

In the first period T1, the scanning signal XSL[i] and the control signal XLM[i] are set to a low level. In the second period T2, the scanning signal XSL[i] is maintained at the low level and the control signal XLM[i] is set to a high level. If the third period T3 starts, the scanning signal XSL[i] is set to the high level from the low level. The control signal XLM[i] is set to the low level from the high level after the scanning signal XSL[i] is set to the high level from the low level.

Next, the detailed operation of the pixel circuit P will be described with reference to FIGS. 3 to 6. Hereinafter, the operation of the pixel circuit P of the $j^{th}$ column belonging to the $i^{th}$ row will be described according to the first to third periods T1 to T3.

a. First Period T1

Figure 4:
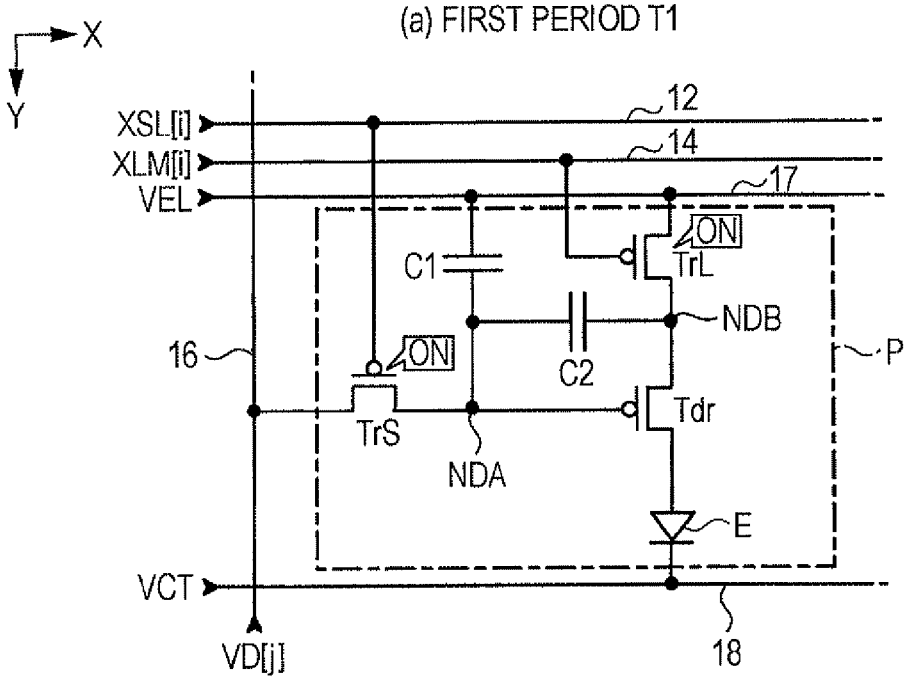
FIG. 4 is a diagram illustrating the operation of a pixel circuit in a first period.

As shown in FIG. 3, the driving circuit 20 (e.g., the scanning line driving circuit 22) sets the scanning signal XSL[i] and the control signal XLM[i] to the low level. Thus, as shown in FIG. 4, the select transistor TrS and the control transistor TrL are turned on. Further, the driving circuit (e.g., the data line driving circuit 24) sets the data potential VD output to the data line 16 to a potential Vdata corresponding to a designated grayscale of the pixel circuit P located at the $j^{th}$ column of the $i^{th}$ row. The gate of the driving transistor Tdr is electrically connected to the data line 16 through the select transistor TrS, so that the potential of the node NDA (the gate of the driving transistor Tdr) is set to Vdata as shown in FIG. 3.

In addition, the source of the driving transistor Tdr is electrically connected to the power feeder line 17 through the control transistor TrL, so that the potential of the node NDB (the source of the driving transistor Tdr) is set to VEL as shown in FIG. 3. According to the embodiment, the difference between the potential VEL and the potential Vdata is set to a value sufficiently larger than the threshold voltage Vth of the driving transistor Tdr.

b. Second Period T2

Figure 5:
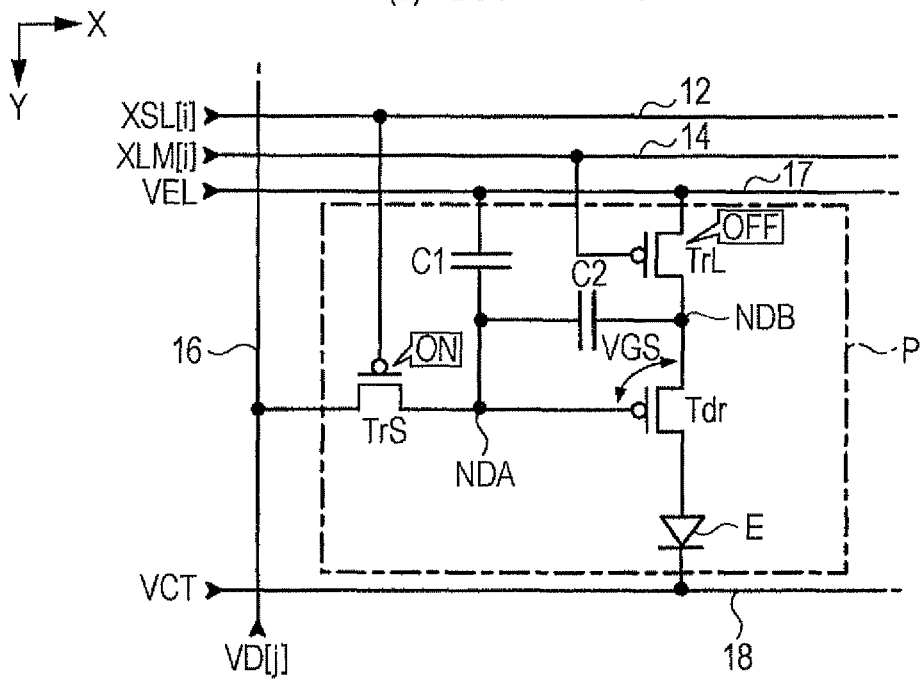
FIG. 5 is a diagram illustrating the operation of a pixel circuit in a second period.

As shown in FIG. 3, the driving circuit 20 (e.g., the scanning line driving circuit 22) sets the control signal XLM[i] to the high level and allows other signals to be maintained in the state of the first period T1. Thus, as shown in FIG. 5, the select transistor TrS is maintained in the on state and the control transistor TrL changes to an off state, so that power supplied to the node NDB is interrupted. Further, charges remaining in the node NDB move to the light emitting element E, so that the potential of the node NDB is reduced with the passage of time (refer to FIG. 3). If the potential of the node NDB reaches Vdata+Vth, the voltage VGS between the gate and the source of the driving transistor Tdr is equal to the threshold voltage Vth, so that the driving transistor Tdr is turned off. Then, before the ending point of the second period T2 is reached, the potential of the node NDB is maintained at Vdata+Vth. That is, in the second period T2, a compensation operation is performed to allow the voltage VGS between the gate and the source of the driving transistor Tdr to approach the threshold voltage VTH.

c. Third Period T3

Figure 6:
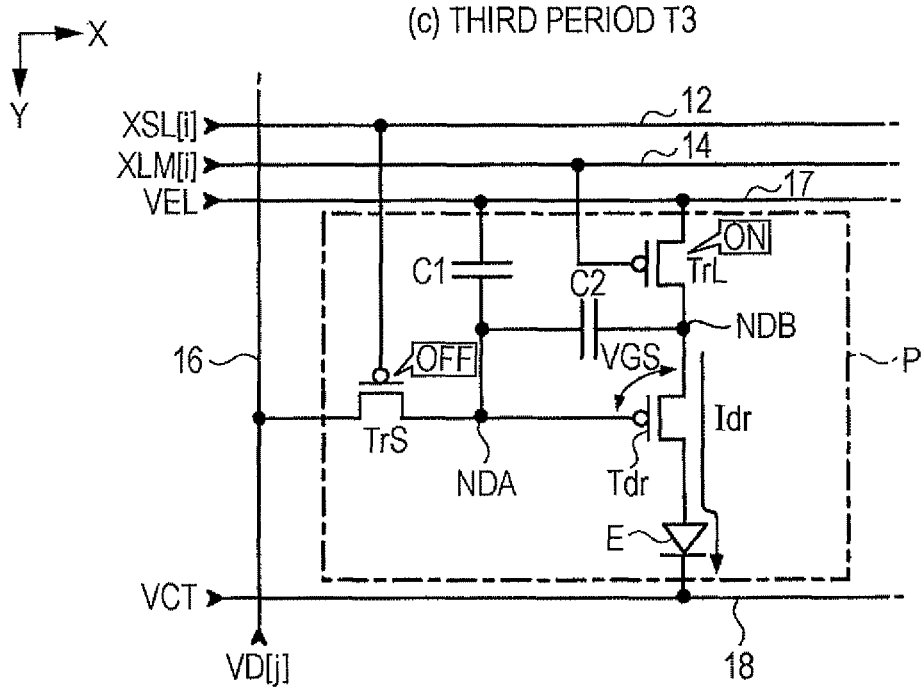
FIG. 6 is a diagram illustrating the operation of a pixel circuit in a third period.

As shown in FIG. 3, if the third period T3 starts, the driving circuit 20 (e.g., the scanning line driving circuit 22) sets the scanning signal XSL[i] to the high level. Thus, as shown in FIG. 6, the select transistor TrS is turned off, so that the gate of the driving transistor Tdr is in an electrically floating state. At this time, the potential of the node NDA is maintained at Vdata by the first and second capacitors C1 and C2.

After setting the scanning signal XSL[i] to the high level, the driving circuit 20 (e.g., the scanning line driving circuit 22) sets the control signal XLM[i] to the low level. Thus, as shown in FIG. 6, the control transistor TrL is turned on, so that the source of the driving transistor Tdr is electrically connected to the power feeder line 17 through the control transistor TrL. Consequently, the potential of the node NDB increases to VEL from Vdata+Vth (refer to FIG. 3). Since the gate of the driving transistor Tdr is in the electrically floating state, the potential of the node NDA (the gate of the driving transistor Tdr) increases in accordance with the potential of the node NDB (the source of the driving transistor Tdr) and reaches Vdata+ΔV. At this time, a driving current IDR corresponding to the voltage VGS between the gate and the source of the driving transistor Tdr flows through the light emitting element E, so that the light emitting element E emits a light with luminance corresponding to the amount of the driving current IDR. In addition, the above-described ΔV=α{VEL−(Vdata+Vth)} and α is a coefficient determined by the capacitance ratio of the first capacitor C1 and the second capacitor C2.

Here, the above-described driving current IDR is expressed by Equation 1 below.

$$IDR = 1/2\beta(VGS - Vth)^2 = 1/2\beta\{(VEL - (Vdata + \Delta V) - Vth)^2 - 1/2\beta\{(VEL - (Vdata + \alpha(VEL - Vdata - Vth) - Vth)^2 = 1/2\beta\{(VEL(1-\alpha) - Vdata(1-\alpha) - Vth(1-\alpha))^2 \quad \text{Equation 1}$$

In Equation 1, since a has α value of 0 to 1, Vdata can be set to a value sufficiently larger than VEL and Vth, so that the driving current IDR has a value (value independent of VEL and Vth) corresponding to Vdata. That is, the driving current IDR supplied to the light emitting element E is determined by the data potential VD corresponding to the designated gray-scale of the light emitting element E and is independent of the threshold voltage Vth of the driving transistor Tdr and the potential VEL of the power feeder line 17.

Figure 15:
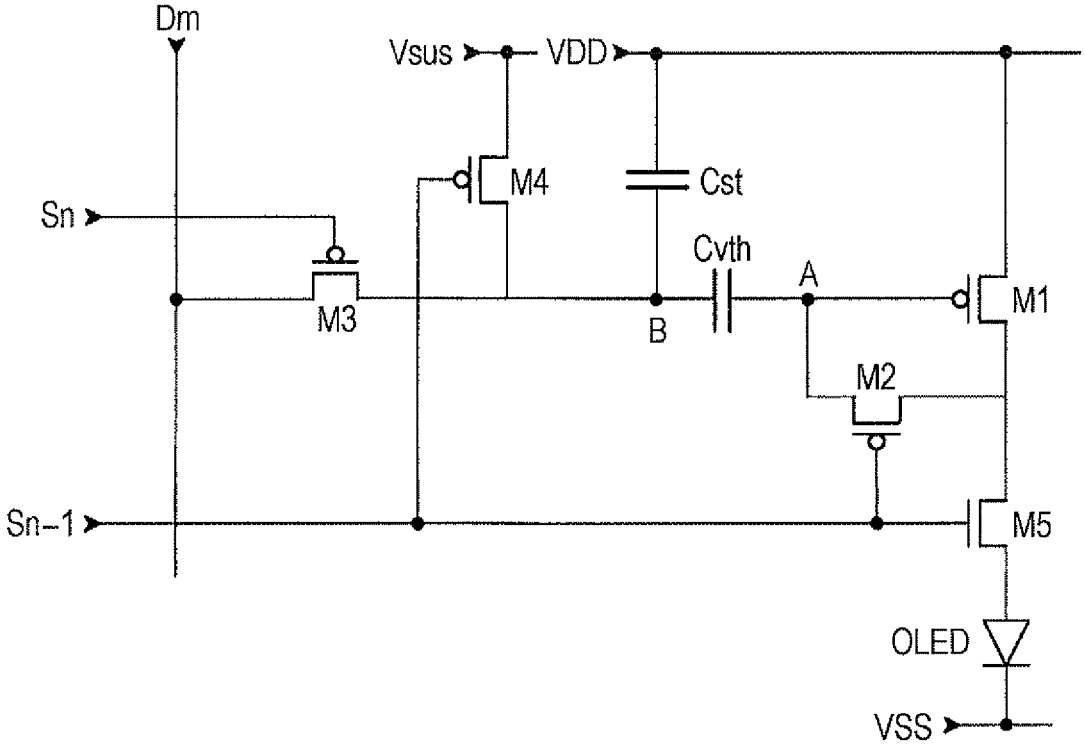
FIG. 15 is a circuit diagram illustrating a pixel circuit in a light emitting apparatus according to the related art.

As described above, according to the embodiment, the number of transistors included in the pixel circuit P is three (the driving transistor Tdr, the control transistor TrL and the select transistor TrS) and the number of the control signals and power sources is small as compared with the related art of FIG. 15, so that the configuration for performing the compensation operation can be simplified as compared with the related art of FIG. 15.

Further, according to the embodiment, in the second period T2 of the writing period PWRT, the compensation operation is performed to allow the voltage VGS between the gate and the source of the driving transistor Tdr to approach the threshold voltage Vth, so that the light emitting period of the light emitting element E can be sufficiently ensured as compared with the related art of FIG. 15 in which the period for performing the compensation operation is provided separately from the writing period.

In addition, according to the embodiment, the driving transistor Tdr, the control transistor TrL and the select transistor TrS included in each pixel circuit P include the same channel type transistor (in the embodiment, a P channel type transistor), so that it is possible to make properties of each transistor included in the pixel circuit P to be uniform, as compared with the related art of FIG. 15.

B. Second Embodiment

Figure 7:
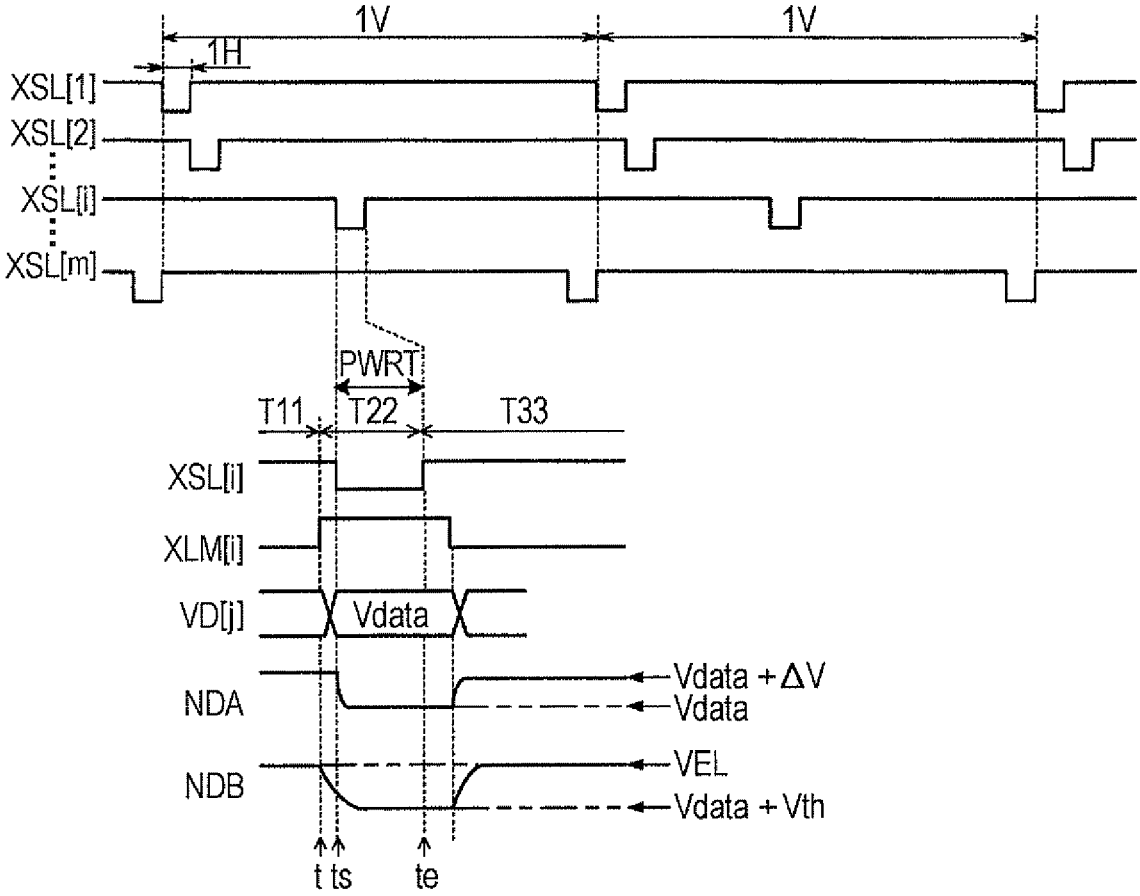
FIG. 7 is a timing chart illustrating the operation of a light emitting apparatus according to a second embodiment.

Since the second embodiment is substantially identical to the first embodiment, except that the control transistor TrL is set to an off state before the writing period PWRT starts and the power supplied to the node NDB is completely interrupted in the writing period PWRT, description about the same configuration will be omitted in order to avoid redundancy. FIG. 7 is a timing chart illustrating the operation of the light emitting apparatus 100 according to the second embodiment.

FIG. 7 will be described while focusing on an $i^{th}$ row. According to the embodiment, the period from the time point t prior to the start point is of the writing period PWRT by a predetermined time length to the end point to of the writing period PWRT is set as a second period T22. Further, the period before the second period T22 is set as a first period T11 and the period after the second period T22 is set as a third period T33.

In the first period T11, the control signal XLM[i] is set to a low level and the scanning signal XSL[i] is set to a high level. If the second period T22 starts, the control signal XLM[i] is set to the high level from the low level. The scanning signal XSL[i] is set to the low level from the high level after the control signal XLM[i] is set to the high level from the low level. If the third period T33 starts, the scanning signal XSL[i] is set to the high level from the low level. The control signal XLM[i] is set to the low level from the high level after the scanning signal XSL[i] is set to the high level from the low level.

Figure 8:
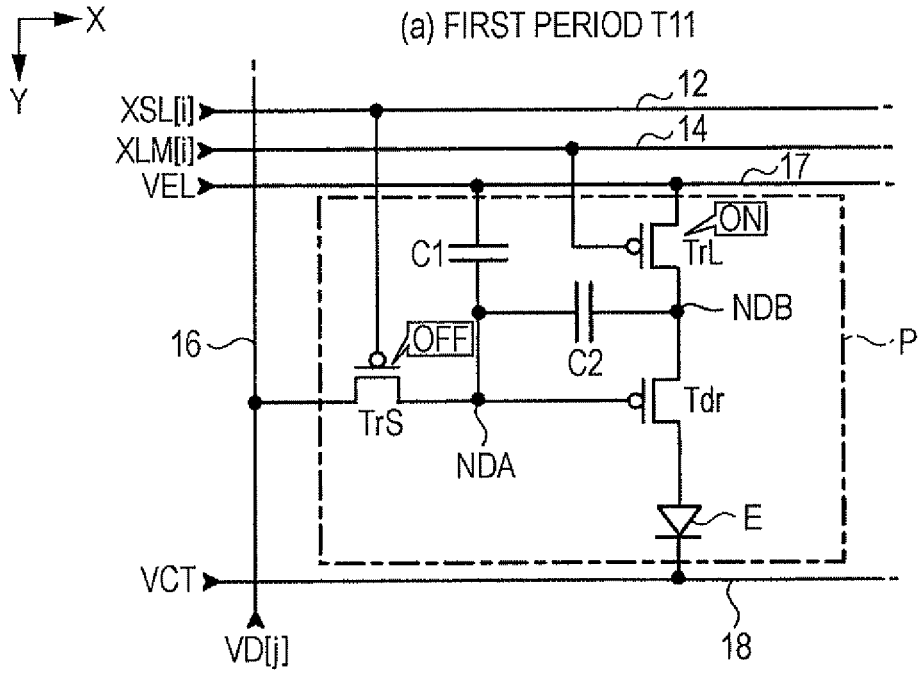
FIG. 8 is a diagram illustrating the operation of a pixel circuit in a first period.
Figure 9:
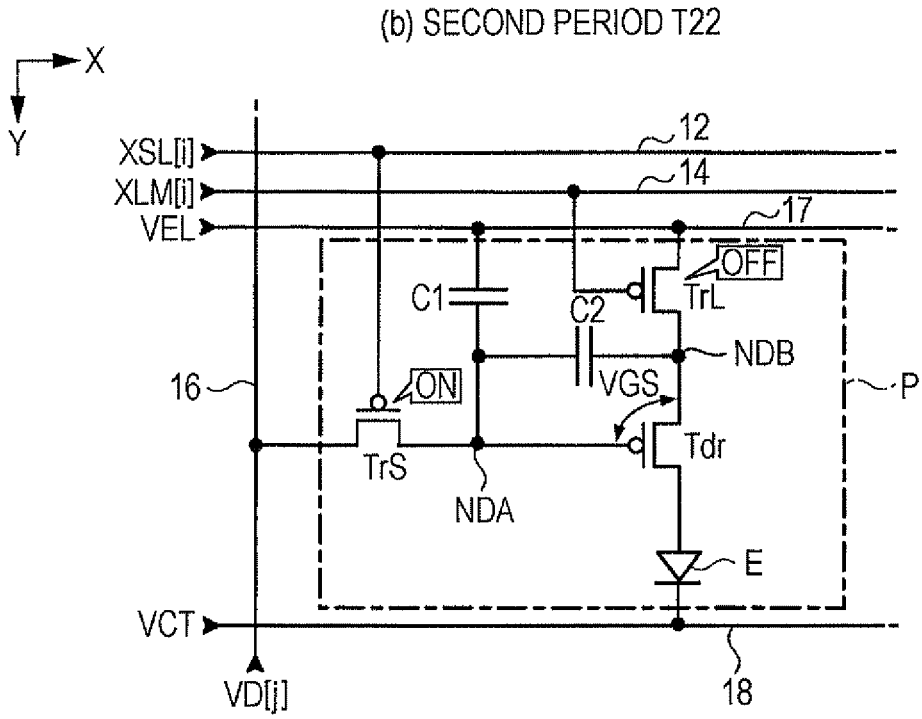
FIG. 9 is a diagram illustrating the operation of a pixel circuit in a second period.

Next, the detailed operation of the pixel circuit P will be described with reference to FIGS. 7 to 9. Hereinafter, the operation of the pixel circuit P of the $i^{th}$ column belonging to the $i^{th}$ row will be described according to the first period T11 and the second period T22. Since the operation of the pixel circuit P in the third period T33 is equal to the operation of the pixel circuit P in the third period T3 according to the first embodiment, description thereof will be omitted.

a. First Period T11

As shown in FIG. 7, the driving circuit 20 sets the control signal XLM[i] to the low level and sets the scanning signal XSL[i] to the high level. Thus, as shown in FIG. 8, the control transistor TrL is turned on and the select transistor TrS is turned off. Further, the source of the driving transistor Tdr is electrically connected to the power feeder line 17 through the control transistor TrL, so that the potential of the node NDB is set to VEL as shown in FIG. 7.

b. Second Period T22

As shown in FIG. 7, if the second period T22 starts, the driving circuit 20 sets the control signal XLM[i] to the high level. Thus, as shown in FIG. 9, the control transistor TrL is turned off, so that power supplied to the node NDB is interrupted. Further, charges remaining in the node NDB move to the light emitting element E, so that the potential of the node NDB is reduced with the passage of time (refer to FIG. 7). After setting the control signal XLM[i] to the high level, the driving circuit 20 sets the scanning signal XSL[i] to the low level, and sets the data potential VD output to the data line 16 to the potential Vdata corresponding to the designated gray-scale of the pixel circuit P located at the $j^{th}$ column of the $i^{th}$ row. The gate of the driving transistor Tdr is electrically connected to the data line 16 through the select transistor TrS, so that the potential of the node NDA (the gate of the driving transistor Tdr) is set to Vdata as shown in FIG. 7.

Meanwhile, if the potential of the node NDB is reduced with the passage of time and reaches Vdata+Vth, the driving transistor Tdr is turned off. That is, a compensation operation is performed to allow the voltage VGS between the gate and the source of the driving transistor Tdr to approach the threshold voltage VTH.

According to the first embodiment as described above, immediately after the writing period PWRT starts, since the data potential VD is written in the state in which the control transistor TrL is turned on, instantaneous high-luminance light emission may occur. However, according to the second embodiment, the control transistor TrL is set to the off state over the period until the writing period PWRT is completed from before the writing period PWRT starts, so that it is possible to prevent the instantaneous high-luminance light emission from occurring immediately after the writing period PWRT starts.

C. Modified Example

The invention is not limited to the previous embodiments. For example, the following modified examples can be made. Further, two or more of the modified examples as described below can be combined.

1. Modified Example 1

Figure 10:
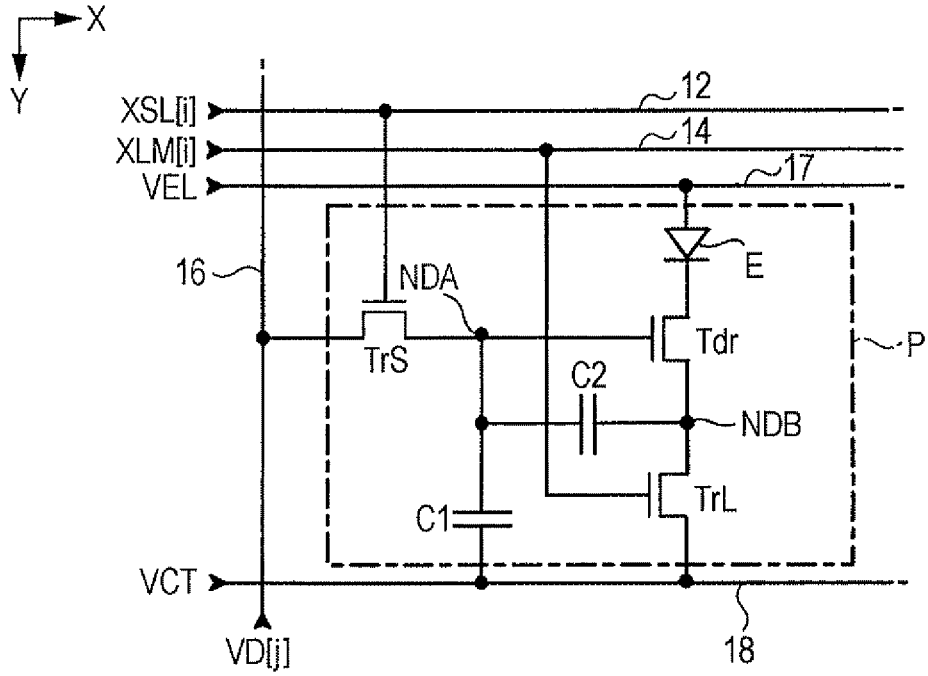
FIG. 10 is a circuit diagram illustrating a pixel circuit according to a modified example.
Figure 11:
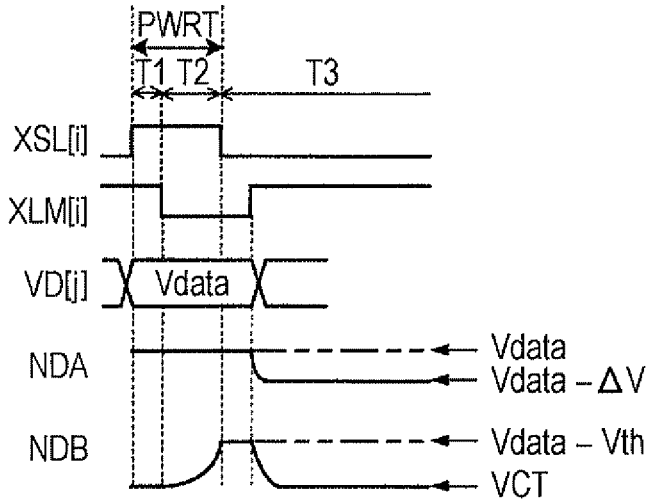
FIG. 11 is a timing chart illustrating the operation of a light emitting apparatus according to a modified example.

According to the first embodiment as described above, all the transistors included in the pixel circuit P include a P channel type transistor. However, the invention is not limited thereto. For example, as shown in FIG. 10, all the transistors included in the pixel circuit P may include an N channel type transistor. FIG. 11 is a timing chart illustrating the operation of the light emitting apparatus 100 when all the transistors included in the pixel circuit P include the N channel type transistor. In the case of employing the N channel type transistor, a voltage relation (high and low) is reversed as compared with the case of employing the P channel type transistor. However, in such a case, since the essential operation is substantially identical to that of the previous embodiments, detailed description about the operation will be omitted. In addition, in FIGS. 10 and 11, similarly to the second embodiment, it is possible to set the control transistor TrL to the off state over the period until the writing period PWRT is completed from before the writing period PWRT starts.

2. Modified Example 2

According to the previous embodiments, the scanning line driving circuit 22 outputs the control signals XLM[1] to XLM [m] to the control lines 14, respectively. However, the invention is not limited thereto. For example, a circuit provided separately from the scanning line driving circuit 22 may output the control signals XLM[1] to XLM[m] to the control line 14, respectively. In short, the driving circuit 20 may include a first unit that generates the scanning signal XSL to supply the scanning line 12 with the scanning signal XSL, a second unit that generates the control signal XLM to supply the control line 14 with the control signal XLM, and a third unit that generates the data potential VD to supply the data line 16 with the data potential VD.

3. Modified Example 3

The light emitting element E may be an OLED (Organic Light Emitting Diode) element, an inorganic light emitting diode or a LED (Light Emitting Diode). In short, all elements, which receive electrical energy (application of an electric field and supply of a current) to emit a light, may be used as the light emitting element of the invention.

D. Application

Figure 12:
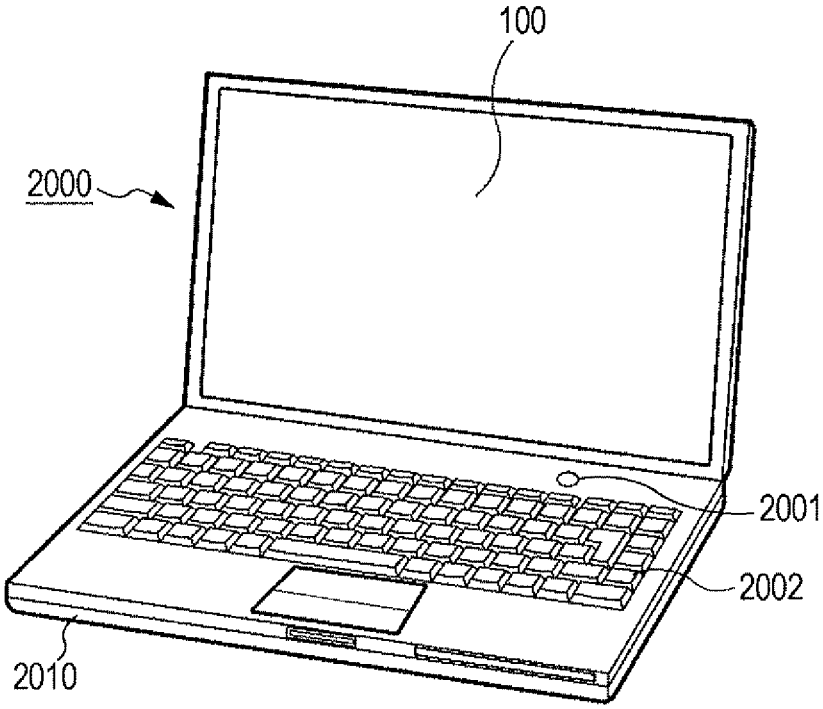
FIG. 12 is a perspective view illustrating a detailed example of an electronic apparatus according to the invention.

Next, an electric apparatus using the light emitting apparatus according to the invention will be described. FIG. 12 is a perspective view illustrating a mobile type personal computer employing the light emitting apparatus 100 according to the embodiment as described above as a display apparatus. The personal computer 2000 includes the light emitting apparatus 100 serving as a display apparatus and a body 2010. The body 2010 is provided with a power switch 2001 and a keyboard 2002. The light emitting apparatus 100 can display an easy-to-see screen with a wide viewing angle by using an OLED element as a light emitting element.

Figure 13:
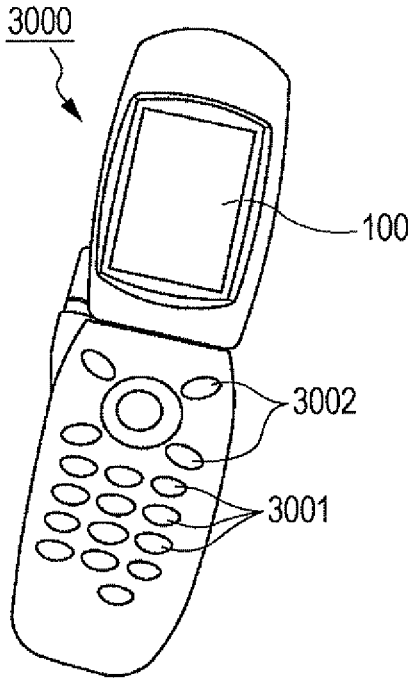
FIG. 13 is a perspective view illustrating a detailed example of an electronic apparatus according to the invention.

FIG. 13 is a perspective view illustrating a cell phone employing the light emitting apparatus 100 according to the embodiment as described above as a display apparatus. The cell phone 3000 includes a plurality of operation buttons 3001, scroll buttons 3002 and the light emitting apparatus 100. The scroll buttons 3002 are operated by a user, so that a screen displayed on the light emitting apparatus 100 is scrolled.

Figure 14:
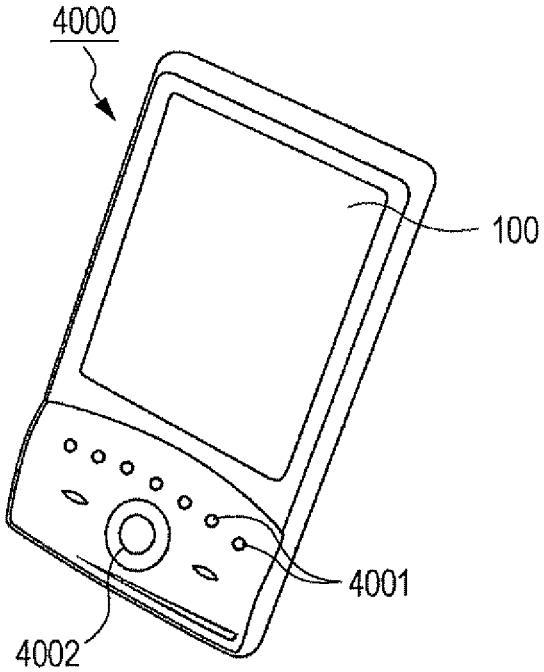
FIG. 14 is a perspective view illustrating a detailed example of an electronic apparatus according to the invention.

FIG. 14 is a perspective view illustrating a PDA (Personal Digital Assistants) employing the light emitting apparatus 100 according to the embodiment as described above as a display apparatus. The PDA 4000 includes a plurality of operation buttons 4001, a power switch 4002 and the light emitting apparatus 100. If the power switch 4002 is operated, the light emitting apparatus 100 displays various pieces of information called an address book and a schedule book.

In addition to the apparatuses exemplified in FIGS. 12 to 14, an electronic apparatus, to which the light emitting apparatus according to the invention is applied, includes a digital still camera, a television, a video camera, a car navigation apparatus, a pager, an electronic organizer, an electronic paper, a calculator, a word processor, a workstation, a television phone, a POS terminal, a printer, a scanner, copy machine, a video player, an apparatus provided with a touch panel, and the like.

The entire disclosure of Japanese Patent Application No. 2009-156602, filed Jul. 1, 2009 is expressly incorporated by reference herein.

What is claimed is:

1. A pixel circuit comprising:

a light emitting element having one terminal and an other terminal;

a driving transistor that supplies a driving current to the one terminal of the light emitting element;

a first power line electrically connected to the other terminal of the light emitting element and receiving a first potential;

a control transistor provided between a second power line, which receives a second potential, and a source of the driving transistor, and having a gate that receives a control signal through a control line;

a first capacitor provided between the second power line and a gate of the driving transistor;

a second capacitor directly connected to the gate of the driving transistor, and provided between the gate and the source of the driving transistor; and a select transistor provided between a data line, which receives a data potential, and the gate of the driving transistor, and having a gate that receives a scanning signal through a scanning line.

2. The pixel circuit according to claim 1, wherein the driving transistor, the control transistor and the select transistor include the same channel type transistor.

3. A driving circuit that drives the pixel circuit according to claim 1, the driving circuit comprising:

a first unit that generates a scanning signal to supply a scanning line with the scanning signal;

a second unit that generates a control signal to supply a control line with the control signal; and a third unit that generates a data potential to supply a data line with the data potential, wherein in a first period, the first unit supplies the scanning line with the scanning signal to allow the select transistor to be turned on, the second unit supplies the control line with the control signal to allow the control transistor to be turned on, and the third unit supplies the data line with the data potential, in a second period, the first unit supplies the scanning line with the scanning signal to allow the select transistor to be turned on, the second unit supplies the control line with the control signal to allow the control transistor to be turned off, and the third unit supplies the data line with the data potential, and in a third period, after the first unit supplies the scanning line with the scanning signal to allow the select transistor to be turned off, the second unit supplies the control line with the control signal to allow the control transistor to be turned on.

4. A driving circuit that drives the pixel circuit according to claim 1, the driving circuit comprising:

a first unit that generates a scanning signal to supply a scanning line with the scanning signal;

a second unit that generates a control signal to supply a control line with the control signal; and a third unit that generates a data potential to supply a data line with the data potential, wherein in a first period, the first unit supplies the scanning line with the scanning signal to allow the select transistor to be turned off, and the second unit supplies the control line with the control signal to allow the control transistor to be turned on, in a second period, after the second unit supplies the control line with the control signal to allow the control transistor to be turned off, the first unit supplies the scanning line with the scanning signal to allow the select transistor to be turned on, and the third unit supplies the data line with the data potential, and in a third period, after the first unit supplies the scanning line with the scanning signal to allow the select transistor to be turned off, the second unit supplies the control line with the control signal to allow the control transistor to be turned on.

5. A light emitting apparatus comprising:

the driving circuit according to claim 3.

6. An electronic apparatus comprising the light emitting apparatus according to claim 5.

7. A driving method of a pixel circuit, which comprises a light emitting element having one terminal and the other terminal, a driving transistor that supplies a driving current to the one terminal of the light emitting element, a first power line electrically connected to the other terminal of the light emitting element and receiving a first potential, a control transistor provided between a second power line, which receives a second potential, and a source of the driving transistor, and having a gate that receives a control signal through a control line, a first capacitor provided between the second power line and a gate of the driving transistor, a second capacitor directly connected to the gate of the driving transistor, and provided between the gate and the source of the driving transistor, and a select transistor provided between a data line, which receives a data potential, and the gate of the driving transistor, and having a gate that receives a scanning signal through a scanning line, the driving method comprising:

in a first period, supplying the scanning line with the scanning signal to allow the select transistor to be turned on, supplying the control line with the control signal to allow the control transistor to be turned on, and supplying the data line with the data potential;

in a second period, supplying the scanning line with the scanning signal to allow the select transistor to be turned on, supplying the control line with the control signal to allow the control transistor to be turned off, and supplying the data line with the data potential; and in a third period, supplying the scanning line with the scanning signal to allow the select transistor to be turned off, and then supplying the control line with the control signal to allow the control transistor to be turned on.

8. A driving method of a pixel circuit, which comprises a light emitting element having one terminal and the other terminal, a driving transistor that supplies a driving current to the one terminal of the light emitting element, a first power line electrically connected to the other terminal of the light emitting element and receiving a first potential, a control transistor provided between a second power line, which receives a second potential, and a source of the driving transistor, and having a gate that receives a control signal through a control line, a first capacitor provided between the second power line and a gate of the driving transistor, a second capacitor directly connected to the gate of the driving transistor, and provided between the gate and the source of the driving transistor, and a select transistor provided between a data line, which receives a data potential, and the gate of the driving transistor, and having a gate that receives a scanning signal through a scanning line, the driving method comprising:

in a first period, supplying the scanning line with the scanning signal to allow the select transistor to be turned off, and supplying the control line with the control signal to allow the control transistor to be turned on;

in a second period, supplying the control line with the control signal to allow the control transistor to be turned off, supplying the scanning line with the scanning signal to allow the select transistor to be turned on, and supplying the data line with the data potential; and in a third period, supplying the scanning line with the scanning signal to allow the select transistor to be turned off, and then supplying the control line with the control signal to allow the control transistor to be turned on.

9. A driving circuit that drives the pixel circuit according to claim 2, the driving circuit comprising:

a first unit that generates a scanning signal to supply a scanning line with the scanning signal;

a second unit that generates a control signal to supply a control line with the control signal; and a third unit that generates a data potential to supply a data line with the data potential, wherein in a first period, the first unit supplies the scanning line with the scanning signal to allow the select transistor to be turned on, the second unit supplies the control line with the control signal to allow the control transistor to be turned on, and the third unit supplies the data line with the data potential, in a second period, the first unit supplies the scanning line with the scanning signal to allow the select transistor to be turned on, the second unit supplies the control line with the control signal to allow the control transistor to be turned off, and the third unit supplies the data line with the data potential, and in a third period, after the first unit supplies the scanning line with the scanning signal to allow the select transistor to be turned off, the second unit supplies the control line with the control signal to allow the control transistor to be turned on.

10. A driving circuit that drives the pixel circuit according to claim 2, the driving circuit comprising:

a first unit that generates a scanning signal to supply a scanning line with the scanning signal;

a second unit that generates a control signal to supply a control line with the control signal; and a third unit that generates a data potential to supply a data line with the data potential, wherein in a first period, the first unit supplies the scanning line with the scanning signal to allow the select transistor to be turned off, and the second unit supplies the control line with the control signal to allow the control transistor to be turned on, in a second period, after the second unit supplies the control line with the control signal to allow the control transistor to be turned off, the first unit supplies the scanning line with the scanning signal to allow the select transistor to be turned on, and the third unit supplies the data line with the data potential, and in a third period, after the first unit supplies the scanning line with the scanning signal to allow the select transistor to be turned off, the second unit supplies the control line with the control signal to allow the control transistor to be turned on.

11. A light emitting apparatus comprising:

the driving circuit according to claim 4.

12. A light emitting apparatus comprising:

the driving circuit according to claim 10.

13. A light emitting apparatus comprising:

the driving circuit according to claim 3, wherein the driving transistor, the control transistor and the select transistor include the same channel type transistor.

14. A light emitting apparatus comprising:

the driving circuit according to claim 9.

15. A light emitting apparatus comprising:

the driving circuit according to claim 4, wherein the driving transistor, the control transistor and the select transistor include the same channel type transistor.

* * * * *